US007958674B2

(12) United States Patent
Meister

(10) Patent No.: US 7,958,674 B2
(45) Date of Patent: Jun. 14, 2011

(54) DOOR SEALING ELEMENT

(75) Inventor: Marcus Meister, Bochum (DE)

(73) Assignee: Meister-Plast GmbH, Witten-Annen (DE)

( * ) Notice: Subject to any disclaimer, the term of this patent is extended or adjusted under 35 U.S.C. 154(b) by 202 days.

(21) Appl. No.: 12/373,361

(22) PCT Filed: Jul. 11, 2007

(86) PCT No.: PCT/EP2007/057075

§ 371 (c)(1),
(2), (4) Date: Jan. 12, 2009

(87) PCT Pub. No.: WO2008/006844

PCT Pub. Date: Jan. 17, 2008

(65) Prior Publication Data

US 2009/0282743 A1 Nov. 19, 2009

(30) Foreign Application Priority Data

Jul. 13, 2006 (DE) ..... 20 2006 010 827 U

(51) Int. Cl.
*E06B 7/28* (2006.01)

(52) U.S. Cl. ..... 49/318; 49/317; 49/303; 49/306

(58) Field of Classification Search ..... 49/303, 49/304, 305, 306, 316, 317, 318, 477.1
See application file for complete search history.

(56) References Cited

U.S. PATENT DOCUMENTS

| | | | | | |
|---|---|---|---|---|---|
| 2,908,948 | A | * | 10/1959 | Jones | 49/303 |
| 3,747,275 | A | * | 7/1973 | May et al. | 49/477.1 |
| 3,968,597 | A | * | 7/1976 | Hirtle | 49/477.1 |
| 4,343,110 | A | * | 8/1982 | Thompson | 49/477.1 |
| 4,706,413 | A | * | 11/1987 | James | 49/477.1 |
| 4,761,917 | A | * | 8/1988 | Knecht et al. | 49/477.1 |
| 4,805,347 | A | * | 2/1989 | Smith | 49/477.1 |
| 4,995,196 | A | * | 2/1991 | Smith | 49/477.1 |
| 5,046,285 | A | * | 9/1991 | Fratini et al. | 49/477.1 |
| 5,209,498 | A | * | 5/1993 | Colin | 277/646 |
| 6,485,029 | B1 | * | 11/2002 | Moody et al. | 277/642 |

FOREIGN PATENT DOCUMENTS

| | | | |
|---|---|---|---|
| DE | 20 2005 003560 | | 6/2005 |
| FR | 2 063 229 | A | 7/1971 |
| FR | 2 166 531 | A | 8/1973 |
| FR | 2 322 997 | A | 4/1977 |
| GB | 2220434 | A * | 1/1990 |

* cited by examiner

*Primary Examiner* — Jerry Redman
(74) *Attorney, Agent, or Firm* — Brinks Hofer Gilson & Lione

(57) ABSTRACT

The present invention relates to a door sealing element for sealing a gap between a movable door and a stationary floor side mating face, comprising two pieces of flexible tubing which are connected to each other such that they communicate on one end, namely a first piece of tubing, to be provided in the region of the door edge on the gap side, and a second piece of tubing, to be provided in the region of a door edge to be moved against a stationary stop surface in a closed position of the door.

20 Claims, 4 Drawing Sheets

DOOR SEALING ELEMENT

CROSS REFERENCE TO RELATED APPLICATIONS

This application claims priority to PCT international patent application number PCT/EP2007/057075, filed Jul. 11, 2007 and DE patent application 20 2006 010 827.0, filed Jul. 13, 2006.

BACKGROUND OF THE INVENTION

The present invention relates to a door sealing element for sealing a gap between an, in particular lower, edge of a movable door and a stationary, in particular on the floor side, mating face, comprising two pieces of flexible tubing, which are connected to each other, such that they communicate on one end (i.e. like "communicating pipes"), namely a first piece of tubing to be provided in the area of the lower door edge and a second piece of tubing to be provided in the area of a door edge to be moved against a stationary stop surface in a closed position of the door. The pieces of tubing are configured such that by means of elastic compression of the second piece of tubing, a defined air volume is displaced into the first piece of tubing, and thus the first piece of tubing is elastically expandable to seal the gap.

The publication DE 20 2005 003 560 U1 describes a device for sealing doors with a sealing element of the cited type. With it, the sealing of a gap is to be achieved automatically in a closed state of the door, particularly a gap between a lower edge of the door and a floor-side mating face. In order to do so, when closing the door, the second piece of tubing, which is in particular arranged vertically on a lateral edge of the door opposite to a stop side, is mechanically compressed between the door and a stop surface (door frame). Because both pieces of tubing are hermetically sealed at their free ends, a defined volume of air is displaced from the second piece of tubing into the first piece of tubing, by means of which the first piece of tubing is elastically expanded to fill the gap. When the door is opened, this process is reversed due to the elasticity of the pieces of tubing, so that the cross-sectional area of the first piece of tubing diminishes, in order to open up the gap. The door can then be opened without friction in the sealing area and subsequently closed again.

The basic object of the invention is configuring a sealing element of the type described, such that it can be mounted in a particularly easy manner, preferably for re-fitting a door in its place of installation.

Inventively, this is achieved by means of an additional closing device that is configured so that the second piece of tubing can be sealed in the direction of its free end, which is situated opposite to the first piece of tubing, by means of mechanical squeezing, or, as the case may be, pinching along its longitudinal extension. This makes assembly simple, because elaborate material joining (heat-sealing) of the open end of the second piece of tubing is not required. In fact, the second piece of tubing only has to be mechanically pinched shut, possibly after trimming to adjust it to the respective door dimension, with the inventive sealing element. This allows for very simple adjustment of the length of the second piece of tubing to the respective door. In addition, using the invention, different air chamber volumes in the second piece of tubing can be sealed off (chambered), which are determined in each case by the internal cross section of the product times the effective length of the piece of tubing. In this way, the volume of air that is displaced in each case into the first piece of tubing when closing the door due to compression of the second piece of tubing can as a result be varied, so that by means of the "adjusted" effective length of the chamber volume of the second piece of tubing, the extension properties and the sealing effect of the first piece of tubing can be adjusted.

In a first embodiment of the invention, the sealing element consists of a common holding strip that is to be arranged on the door, together with the second piece of tubing in a parallel-extending arrangement, and at least one closing clamp, whereby the closing clamp, with the interposition and pinching-off of the second piece of tubing, is detachably connectable with the holding strip, in particular, that it can be sealed in a form-fitting, "clip-like" manner. In this case, the holding strip features holding means on the opposite lateral edge areas, with which corresponding holding elements of the closing clamp interact, said holding means overlapping, in a bridge-like manner, the holding strip and the second piece of tubing. It is also advantageous to configure the holding strip and the closing clamp in combination with the second piece of tubing, in order to adapt to the respective door-installation situation in such a way that the closing clamp makes contact with the stationary stop surface in a closed state of the door in such a way that an additional mechanical pressing force is applied to the clamp, in order to cause pressure-tight sealing of the second piece of tubing.

In a second preferred embodiment of the invention, the closing device features a clamping part which is not affixed together with the second piece of tubing to the door, but rather advantageously to the fixed stop surface. In this case, the clamping part is detachable and can be attached by using suitable holding means in different places along the length of the stop surface provided for the attachment of the second piece of tubing. The clamping part is configured as an adjustment to the respective mounting situation in the door area in such a way that when the door is closed, the second piece of tubing, which is still open at the end, is moved first against the clamping part, and in that way clamped and sealed at the open end. In this closed state of the second piece of tubing, however, a further closing movement of the door is possible, in order to sufficiently compress the sealed piece of tubing. This means that the clamping part may not act as a spacer between door and stopping surface, or at least not until the second piece of tubing is compressed enough to guarantee the desired gap-sealing due to the extension of the first piece of tubing. This preferred embodiment results in the particular advantage that when the door is open, the second piece of tubing is always open at its free end, which results in automatic pressure equalization.

It should be noted that the invention is in principle suitable for any type of door, in particular normal swinging doors, but also, for example, sliding doors.

Additional advantageous characteristics of embodiments of the invention are seen in the independent claims and the following description.

The invention will be explained in more detail using the preferred embodiments shown in the drawing. The following is shown:

BRIEF DESCRIPTION OF THE DRAWINGS

In the different figures of the drawing, the same or, as the case may be, functionally similar parts are always provided with the same reference signs.

DETAILED DESCRIPTION

Figure 1:
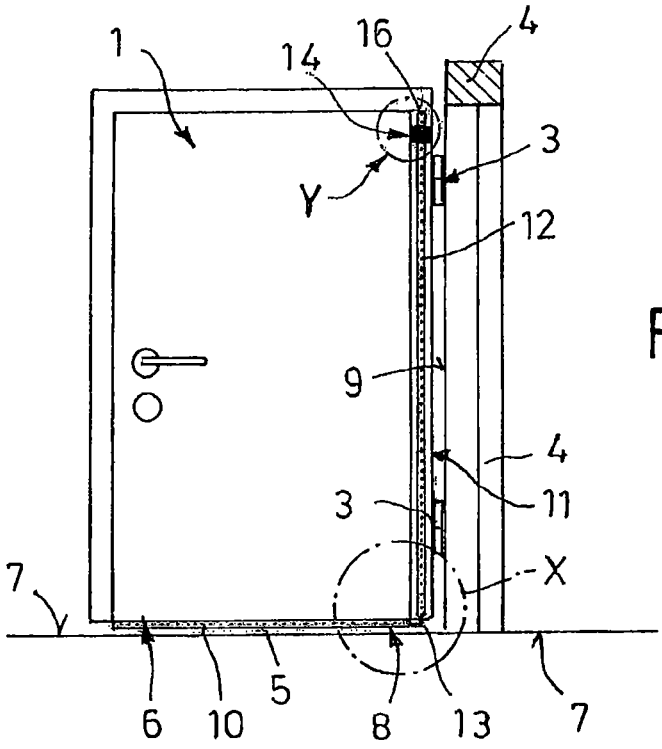
FIG. 1 A schematic representation of a door that can be pivoted, which is attached to a door frame and is open at an angle of approximately 90°, with an inventive sealing element that is comprised of two pieces of tubing, FIG. 2 An enlarged partial view of the door in the area X according to FIG. 1, FIG. 2*a* A somewhat enlarged section of FIG. 2 in a preferred embodiment in the connecting area of the two pieces of tubing, FIG. 3 An enlarged partial cross sectional view at the level III-III in FIG. 2, FIG. 4 An enlarged section at the level IV-IV in FIG. 2, FIG. 5 An enlarged view of the region Y in FIG. 1 with an inventive sealing element in a first embodiment, FIG. 6 A lateral view in arrow direction VI according to FIG. 5, FIG. 7 A view similar to FIG. 6 without a piece of tubing, FIG. 8 An additional schematic view of a door that is attached to a door frame such that it can pivot, in a state of being opened, to approximately 180°, with a second preferred embodiment of an inventive sealing element, FIG. 9 An enlargement of a section of FIG. 8 in the region of clamping part that is affixed to the door frame and can be fixed in different positions, and FIG. 10 a separate perspective views of the clamping part according to FIGS. 8 and 9.
Figure 2:
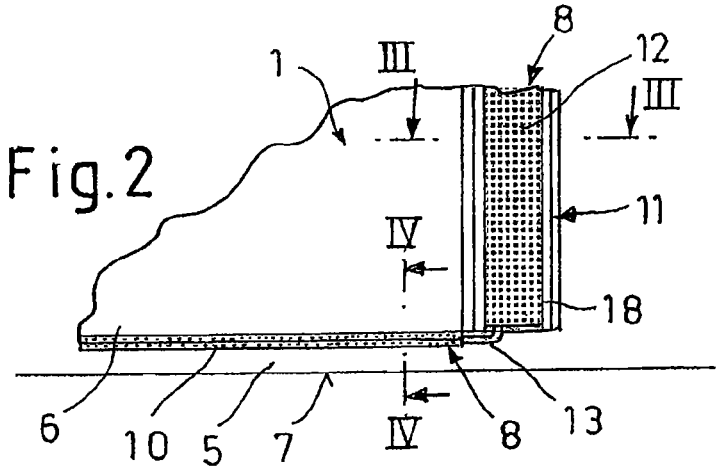
Figure 2A:
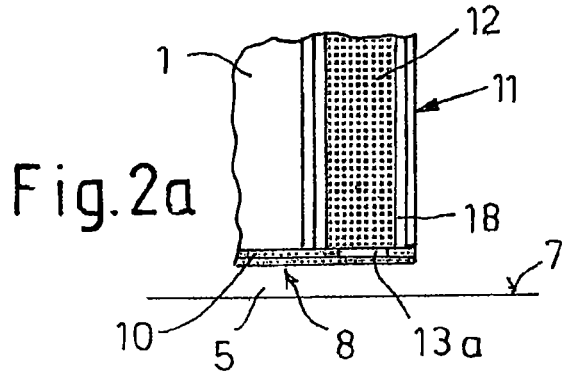
Figure 3:
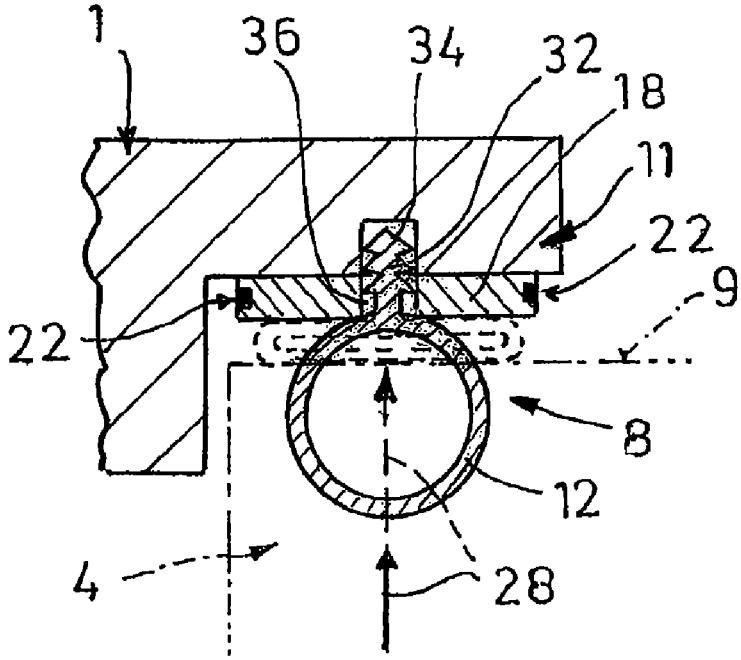
Figure 4:
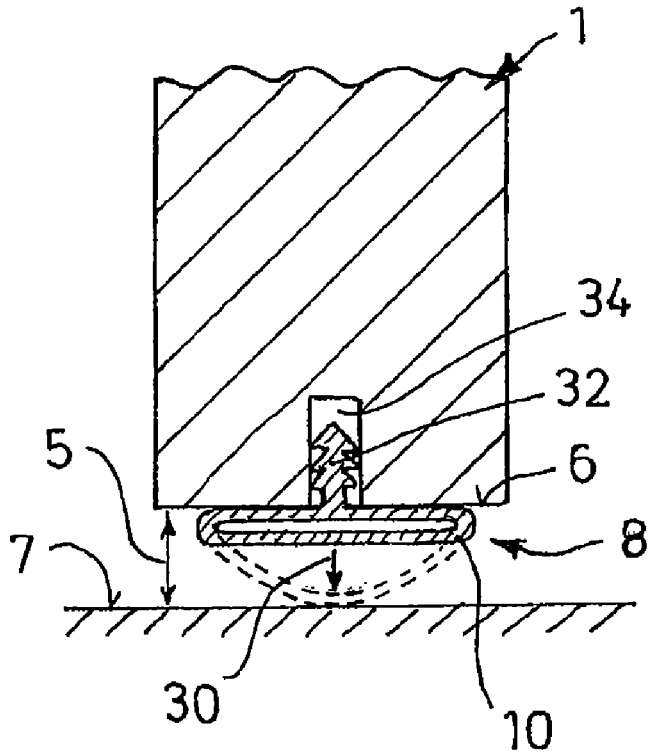

In FIGS. 1 and 2, for example, a door 1 is illustrated which is attached in a pivotable manner for the purpose of opening and closing by means of hinges 3 to a door frame 4. In order to seal a gap 5 between an, in particular lower edge 6 of the door 1 and a stationary, particularly on the floor side, mating face 7, a sealing element 8 is provided. This sealing element 8 is comprised of two elastic pieces of tubing 10, 12, a first piece of tubing 10 arranged in the region of the lower door edge 6 and a second piece of tubing 12 that is to be arranged in the region of a door edge 11, which, in a closed position of the door 1, is to be moved against a fixed stop surface 9 of the door frame 4. The two pieces of tubing 10, 12 are connected in an air-tight, "communicating" manner at one end, in the area of their facing ends. According to FIGS. 1 and 2, this can be an indirect connection via a preferably flexible, tube-shaped connecting piece 13. In a preferred embodiment according to FIG. 2*a*, however, the pieces of tubing 10, 12 are directly connected, being in particular directly heat-sealed to each other. For this purpose, the first (lower) piece of tubing 10 is hermetically sealed at both ends by means of clamping and heat-sealing and provided with an opening 13*a* in the area of one end. The second (upper) piece of tubing 12 is then bluntly heat-sealed at its front end, overlapping or, as the case may be, enclosing the opening 13*a* in such a way with the upper side of the first piece of tubing 10, that the inner volumes of the pieces of tubing 10, 12 are joined in a communicating manner and are outwardly hermetically sealed. By means of the described, preferred method of connection, the connected pieces of tubing according to FIG. 2*a* enclose a right angle (90°). In addition, the pieces of tubing 10, 12, are in this way configured such that by means of mechanical, elastic compression of the second piece of tubing 12, a certain volume of air is forced out of said piece of tubing and into the first piece of tubing 10, and that in this way the cross section of the first piece of tubing 10 can be elastically expanded to seal a gap. This function is illustrated in FIGS. 3 and 4. Based on the situation completely illustrated in FIG. 3, the door 1, when being closed, is moved with its edge 11 in the direction of the stop surface 9 (indicated by the dotted line), which causes the second piece of tubing 12 to be compressed (drawn with dotted line). The volume of air forced out in this way is displaced as seen in FIG. 4 through the connecting piece 13 into the first piece of tubing 10 which then expands into the position shown by the dotted line, in order to seal the gap 5.

The second piece of tubing 12 is arranged (see FIG. 3) in a folding area on the lateral edge 11 of the door 1 on the hinge-side in the illustrated, preferred embodiments. In this way, the adjacent pieces of tubing 10, 12, enclose a right angle across a lower edge of the door 1. The preferable arrangement of the second piece of tubing 12 on the lateral edge 11 of the door 1 facing the hinge-side advantageously avoids all of the problems closing the door which could result from the necessary compression of the piece of tubing 12 in the region of the door lock.

Inventively, a mechanical closing device 14 is provided for the second piece of tubing 12, regarding which reference is made in particular to the representations in FIGS. 5 to 7 and FIGS. 8 to 10. As such, the closing device 14 performs the function of closing the second piece of tubing 12 in the direction of its free and actually open end 16, which is opposite to the connection with the first piece of tubing 10 by means of mechanical clamping or, as the case may be, pinching. Such a closing is advantageously possible at different points on the longitudinal extension of the second piece of tubing 12.

Figure 5:
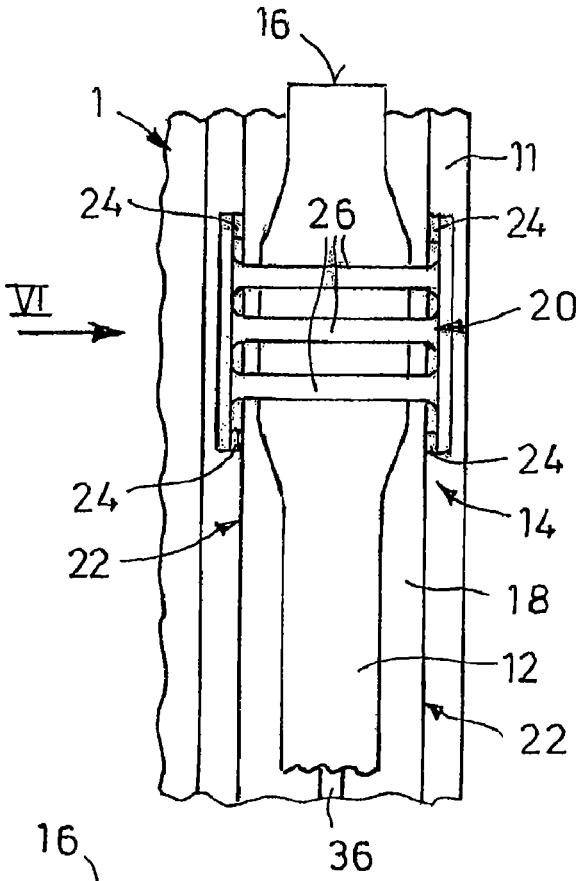
Figure 6:
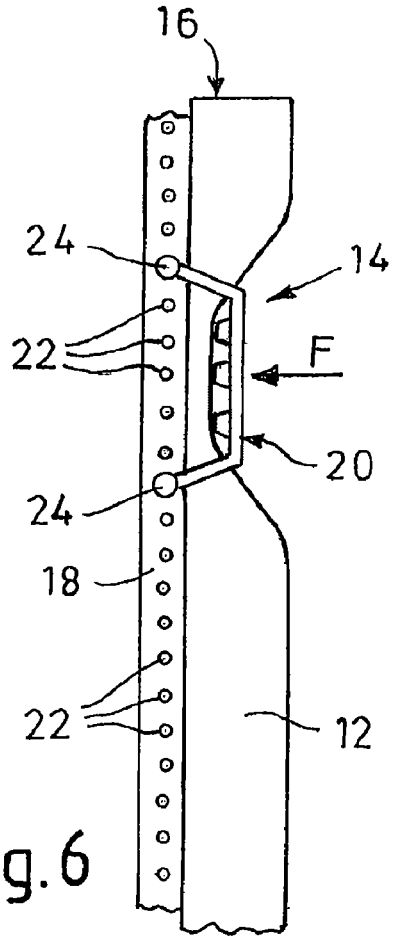
Figure 7:
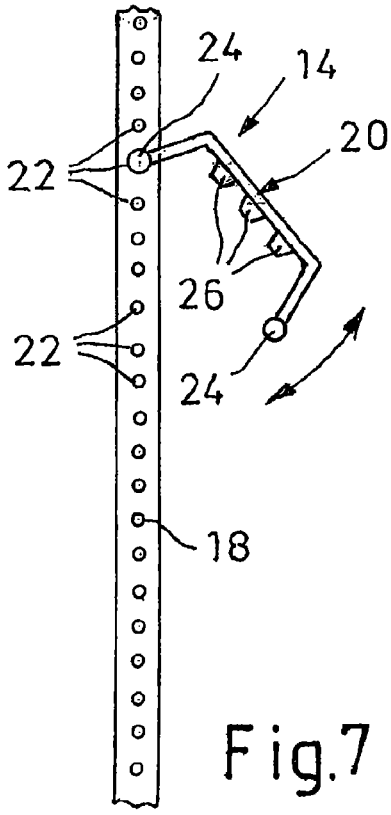

For this purpose, the closing device 14 in the first embodiment according to FIGS. 5 to 7 is comprised of a holding strip 18 which is to be arranged parallel to the second piece of tubing 12 on the door 1 in the region of the edge 11 and at least one closing clamp 20. The closing clamp 20 can be detachably connected at different points to the holding strip 18 during interposition and clamping of the second piece of tubing 12, and it can, in particular, be clipped to it in a form-fitting way. The holding strip 18 may be made of metal or a suitable plastic. The closing clamp 20 is preferably made of plastic. The holding strip 18 features holding means 22 in its two opposite lateral edge regions with which corresponding holding elements 24 of the closing clamp 20 interact. In an assembled condition according to FIGS. 5 and 6, the closing clamp 20 overlaps the holding strip 18 and the second piece of tubing 12 in a bridge-like way, so that the second piece of tubing 12 is essentially tightly sealed by being clamped off. It is advantageous if the holding strip 18 and the closing clamp 20 are configured as an adaptation to the second piece of tubing 12 and as an adaptation to any given door-installation situation, in such a way that in a closed state of the door 1, the closing clamp 20 contacts the fixed stop surface 9 in such a way that an additional compression force F (see the arrow drawn into FIG. 6) is applied to the clamp, in order to ensure hermetic sealing of the second piece of tubing 12. In order for this to be the case, however, the cross-sectional area of the second piece of tubing, according to FIG. 6, must be such that sufficient compression to displace a sufficient volume of air is also guaranteed.

In the embodiment shown in FIGS. 6 and 7, the holding strip 18 features stop openings (holes) as holding means 22 that are distributed evenly along its length. As catch elements 24, the closing clamp 20 features corresponding catch projections, particularly for a form-fitting engagement of the stop openings. In this embodiment, there is a stepped displacement of the closing clamp 20 and therefore also of the effective length of the second piece of tubing 12.

In the case of an alternative that is not illustrated, the holding strip 18 can feature as holding means 22 lateral lengthwise slots which, by interacting with the catch elements 24 of the closing clamp 20, enable continuous change of position. A form-fitting catch connection can also be provided with an undercut in the region of the lengthwise slots.

As additionally illustrated in FIGS. 5 to 7, the closing clamp 20 preferably features three parallel clamping crosspieces 26, particularly ones made of soft PVC, which diagonally overlap the second piece of tubing 12.

According to FIG. 3, the second piece of tubing 12 features a maximum inner cross section in a mechanically non-deformed original state which, as shown, is in particular at least approximately circular. The second piece of tubing 12 can then be pinched together (compressed) in the direction of the arrow 28.

As is also shown in FIG. 4, the first piece of tubing 10 features a minimal inner cross section in a slack, non-deformed, unstretched original state, in particular a flatly oval or approximately flatly rectangular (slot-shaped). In this way, the parallel walls can almost lay one of top of the other, whereby the inner cross section is then almost zero. From this original state, an extension to seal a gap is possible in the direction of the arrow 30 drawn into FIG. 4.

In an additional, preferred embodiment e.g. (see FIGS. 3 and 4) the first and second pieces of tubing 10, 12 each feature an integrally molded holding section lug 32, in particular one with a barbed fir-tree profile. This enables very simple fixation on the door 1, in that in each case, the holding section lug 32 is simply inserted into a door-side lug bore 34. According to FIG. 3, the holding strip 18 hereby features a longitudinal slot 36 for inserting the holding lug 32 (here see FIG. 5 as well).

The holding strip 18 has, in particular, a material connection or other suitable connection (rigid) with the door 1, and in such a way that the slot 36 overlaps the lug bore 34 (see FIG. 3).

Figure 8:
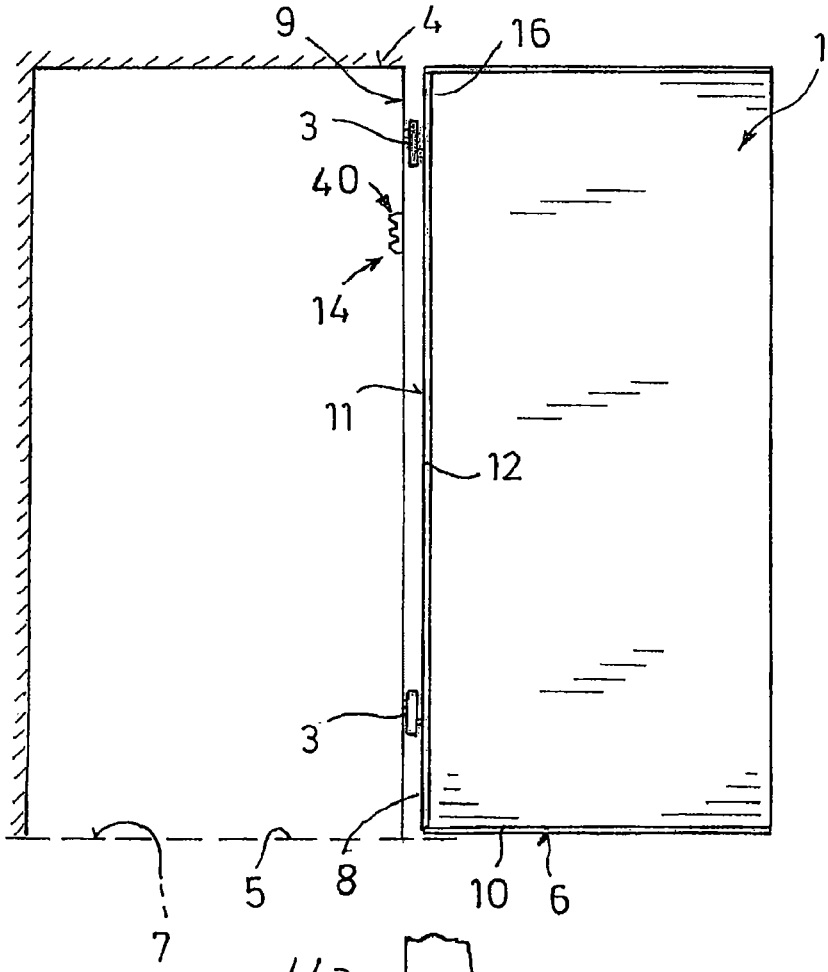
Figure 10:
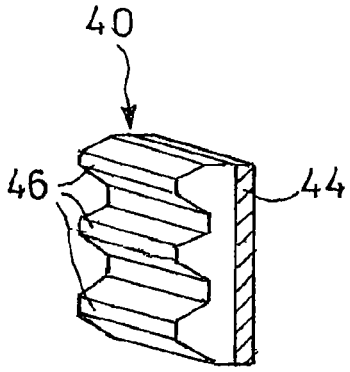
Figure 9:
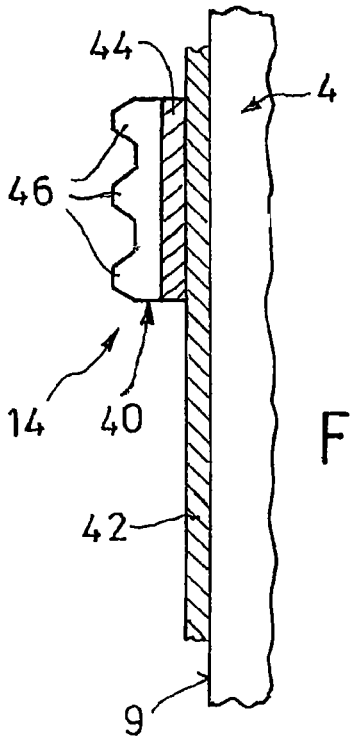

As far as the preferred embodiment according to FIGS. 8 to 10 is concerned, the closure device 14 features a clamping part 40 which in this case is not affixed to the door 1, but rather to the fixed stop surface 9, or it can be connected to said surface in such a way that when closing the door 1, the piece of tubing 12 affixed there which is initially open at the end moves against the clamping part 40 and is in that way pinched and closed at the open end 16. Advantageously, the clamping part 40 is detachable and thus movably affixed or can be movably affixed by means of a suitable holding means to the stop surface 9. In that way, the clamping part 40 can be affixed at different points along the length of the stop surface 9 and thus also along the length of the second piece of tubing 12. A hook and loop (e.g., VELCRO®) strip 42 is advantageously provided, in particular, as a holding means for the clamping part 40, said strip being advantageously glued to the stop surface 9. On its reverse side, the clamping part 40 features a holding layer 44 that interacts with the hook and loop (e.g., VELCRO®) strip 42, as is known in principle from normal hook and loop (e.g., VELCRO®) fasteners. In this context, particular reference is made to the enlarged illustration in FIG. 9.

On its front side, the clamping part 40 features at least one clamping crosspiece 46 which extends diagonally to the longitudinal extension of the second piece of tubing 12 to be clamped. In the illustrated preferred embodiment (see particularly FIGS. 9 and 10), the clamping part 40 features three rib-type clamping crosspieces 46 positioned parallel to each other.

It is essential that the clamping part 40 be configured in such a way that, depending on the current mounting situation in the area of the door 1 and the door frame 4, when closing the door 1 in a state where the second piece of tubing 12 is already closed off by being pinched from contact with clamping part 40, further closing movement of the door 1 is still possible, so that the piece of tubing 12 which is closed at its end 16 can still be sufficiently compressed to displace a sufficient volume of air to expand the first piece of tubing 10, in order to provide adequate gap-sealing. In other words, this means that the clamping part 40 must be configured in such a way, that it does not act as a spacer between the door 1 and the stop surface 9 or only acts as such, when the piece of tubing 12 is sufficiently compressed to close the gap.

As explained at the beginning, this embodiment is advantageous, because it produces automatic pressure equalization, in that when the door 1 is opened, the second piece of tubing 12 is always open at the free end 16. Therefore, inside the inventive sealing element 8, the external atmospheric pressure prevails at any given time. In addition, this is a particularly simple and economical embodiment in terms of construction, and it is also easy to operate.

Furthermore, with regard to the first piece of tubing 10, it features at any given time, a length corresponding to the length of the lower edge 6, in order to seal the entire gap 5 along its entire length. In addition, the free end of the first piece of tubing 10 is preferably closed by means of a material fit, in particular by being heat-sealed. Prefabrication for normal door dimensions is possible. Alternatively, the first piece of tubing 10 can be cut to size and heat-sealed, in particular with a portable heat-sealing device (hand-held heat-sealing device). In principle, however, the first piece of tubing 10 could be closed with a corresponding closing device (14) through mechanical clamping, similar to the second piece of tubing 12.

It should also be noted that, when refitting an existing door 1 with an inventive sealing element 8 (in which case the two pieces of tubing 10, 12 each preferably feature sufficient "excess length" to accommodate different doors and be cut to fit different lengths), the second piece of tubing 12 possibly after trimming can also in principle be closed by heat-sealing. In that respect, the term "mechanical clamping" can also include clamping by means of an adhesive bond in the sense of heat-sealing.

In the illustrated and described embodiments and examples of application, the first piece of tubing 10 acts directly as the sealing element against the stationary mating surface 7. Alternatively, however, it is also possible for the first piece of tubing 10 to act, for the purpose of indirect sealing, as an actuation element against an additional, strip-shaped sealing element that is movably arranged on the door 1.

The invention is not restricted to the illustrated and described embodiments, but rather encompasses all embodiments that perform in the sense of the invention. Furthermore, the invention has not so far been limited to the combination of characteristics defined in the claims, but rather can also be defined by any number of other combinations of specific characteristics of all the published individual characteristics. This means that as a matter of principle, practically every individual feature of the claims can be omitted, or as the case may be, replaced by at least one individual feature disclosed at another point in the application. In that respect the claims are to be understood only as a first attempt at formulation for an invention.

The invention claimed is:

1. A door sealing element for sealing a gap between a lower edge of a movable door and a stationary floor mating face, comprising a first and a second piece of flexible tubing, the first and the second pieces of flexible tubing are connected to each other at a connection, such that they communicate at respective first ends thereof, the first piece of tubing further having a second open end, the first piece of tubing to be provided in the region of the lower edge and the second piece of tubing to be provided in the region of a lateral door edge to be moved against a stationary stop surface in a closed position of the door, whereby the first and the second pieces of tubing are configured, such that by means of elastic compression of the second piece of tubing, a defined air volume is displaced from the second piece of tubing into the first piece of tubing, and thus the first piece of tubing is elastically expandable to seal the gap, a closing device is provided which closes the second piece of tubing at a point on its longitudinal extension by mechanical clamping in the direction of the second open end of the second piece of tubing, which lies opposite to the connection with the first piece of tubing.

2. A sealing element according to claim 1, wherein the second piece of tubing forms a spherical inner cross section in a mechanically non-deformed original state.

3. A sealing element according to claim 1 wherein the first piece of tubing forms a generally flat, oval or approximately flatly rectangular inner cross section, in an unextended original state.

4. A sealing element according to claim 1 wherein externally, both the first piece of tubing and the second piece of tubing have a door-side holding section lug configured for retention into a lug bore.

5. A sealing element according to claim 1 wherein the first piece of tubing comprises a length corresponding to the length of the lower edge, whereby a second end of the first piece of tubing is heat-sealed.

6. A sealing element according claim 1 wherein the first and the second pieces of tubing are connected at the connection indirectly or directly by means of a flexible connecting piece.

7. A sealing element according to claim 1 wherein the first piece of tubing forms a seal against the floor mating face.

8. A sealing element according to claim 1 wherein the first piece of tubing, for direct sealing, acts as an actuating element against an additional, strip-shaped sealing element that is movably arranged on the door.

9. A sealing element according to claim 1 wherein the second piece of tubing is to be arranged on the lateral door edge which is a hinge-side door edge of the door, which is pivotably mounted by means of hinges.

10. A sealing element according to claim 1 wherein the closing device is comprised of a holding strip that is arranged along with the second piece of tubing in a parallel arrangement on the door, and at least one closing clamp, whereby the closing clamp, for the closing of the second piece of tubing is detachably connectable and is configured to be positively locked with the holding strip.

11. A sealing element according to claim 10, wherein the holding strip comprises holding means in opposite lateral edge areas, with which corresponding holding elements of the closing clamp interact, for overlapping the holding strip and the second piece of tubing.

12. A sealing element according to claim 10 wherein the closing clamp comprises at least two parallel clamping cross-pieces that diagonally overlap the second piece of tubing.

13. A sealing element according to claim 10 wherein the holding strip comprises a longitudinally extending slot for a holding section lug of the second piece of tubing.

14. A sealing element according to claim 10 wherein the holding strip can be fixedly connected to the door.

15. A sealing element according to claim 10 wherein the holding strip and the closing clamp, in adjusting to the respective door-installation situation, are configured, such that in a closed state of the door, the closing clamp contacts the stationary stop surface and an additional mechanical pressing force (F) is applied to the clamp, in order to cause pressure-tight sealing of the second piece of tubing.

16. A sealing element according to claim 1 wherein the closing device comprises a clamping part for the second piece of tubing to be arranged on the door, the clamping part being on the stationary stop surface, and it being possible to affix the clamping part at different points, such that when closing the door, the second piece of tubing which is initially open at the second open end moves against the clamping part and is pinched off in that way and closed at the second open end.

17. A sealing element according to claim 16, wherein the clamping part is detachable and movably affixed using a hook and loop strip affixed to the stop surface.

18. A sealing element according to claim 17, wherein the clamping part comprises a holding layer on a reverse side that interacts with the hook and loop strip.

19. A sealing element according to claim 16 wherein the clamping part comprises on its front side clamping cross-pieces in the form of ribs that extend diagonally to a longitudinal extension of the second piece of tubing.

20. A sealing element according to claim 16 wherein the clamping part is configured depending on the current mounting situation, such that when closing the door with the second piece of tubing already closed by being pinched together, a further closing movement of the door is still possible, in order to compress the closed second piece of tubing.

* * * * *